US009970093B2

(12) United States Patent
Gaertner

(10) Patent No.: US 9,970,093 B2
(45) Date of Patent: May 15, 2018

(54) METHOD FOR GAS CARBONITRIDING

(71) Applicant: Robert Bosch GmbH, Stuttgart (DE)

(72) Inventor: Bernd Gaertner, Schnuerpflingen (DE)

(73) Assignee: Robert Bosch GmbH, Stuttgart (DE)

( * ) Notice: Subject to any disclaimer, the term of this patent is extended or adjusted under 35 U.S.C. 154(b) by 586 days.

(21) Appl. No.: 14/570,544

(22) Filed: Dec. 15, 2014

(65) Prior Publication Data

US 2015/0167145 A1 Jun. 18, 2015

(30) Foreign Application Priority Data

Dec. 16, 2013 (DE) ..... 10 2013 226 090

(51) Int. Cl.
*C23C 8/34* (2006.01)

(52) U.S. Cl.
CPC ..... *C23C 8/34* (2013.01)

(58) Field of Classification Search
CPC ..... C23C 8/32
See application file for complete search history.

(56) References Cited

U.S. PATENT DOCUMENTS

2014/0246126 A1* 9/2014 Horimoto ..... C21D 9/28
148/218

FOREIGN PATENT DOCUMENTS

EP 1 122 331 B1 3/2003
EP 1 122 330 B1 10/2004

* cited by examiner

*Primary Examiner* — Jessee Roe
(74) *Attorney, Agent, or Firm* — Maginot, Moore & Beck LLP

(57) ABSTRACT

A method of forming a wear protection layer for a machine component that forms a slide pairing with a further machine component includes gas-carbonitriding at least one of the machine components in order to minimize wear. The gas-carbonitriding includes forming a thin uniform bonding layer and a comparatively thick diffusion layer thereunder. The gas-carbonitriding is performed at a low temperature and for a long duration.

12 Claims, 1 Drawing Sheet

METHOD FOR GAS CARBONITRIDING

This application claims priority under 35 U.S.C. § 119 to patent application no. DE 10 2013 226 090.3, filed on Dec. 16, 2013 in Germany, the disclosure of which is incorporated herein by reference in its entirety.

The disclosure relates to a method for gas carbonitriding, which serves for forming a wear protection layer on a sliding surface of a machine component.

BACKGROUND

It is known from the prior art to carbonitride the machine components of the sliding partners. In this heat treatment method, the chemical composition of the boundary layer is modified, so that the strength is increased and the wearing behavior is improved.

Thus, according to the prior art, machine components are carbonitrided in a salt bath. The disadvantage of this is that soiling caused by residues of the salt bath may occur on the component.

EP 1 122 330 B1 and EP 1 122 331 B1 disclose methods for the carbonitriding of components by means of gas, this being designated below as gas carbonitriding.

SUMMARY

The object of the disclosure is to provide a method for gas carbonitriding, by means of which slide pairings can be produced cost-effectively and, furthermore, have a longer service life and are more failsafe even under high system pressures and under high frictional forces resulting from these, so that the slide pairing and therefore the machine affected have a long useful life.

This object is achieved by means of a method disclosed herein.

According to the disclosed method for gas carbonitriding, an iron-containing machine component of a slide pairing, in a first step, is acted upon with gas in a furnace at a comparatively low treatment temperature and for a comparatively long treatment duration. A comparatively thin bonding layer and a comparatively thick diffusion layer are therefore formed. In this case, the bonding layer is of uniform thickness. In a subsequent second step or in a second stage, carbon donor is added and the treatment temperature increased. As a result, the carbon content of the bonding layer is increased. In the second stage, therefore, by carbon donors being added, the carbonizing potential of the furnace atmosphere is increased and therefore the carbon content of the bonding layer is increased. So that this takes place quickly and without an appreciable layer growth, the second stage is usually carried out at higher treatment temperatures. Since the dimensional changes of the machine component which, according to the disclosure, is gas-carbonitrided in two stages are reduced in comparison with the prior art, it becomes possible to have higher process safety and higher operating safety of the slide pairing, particularly in the case of components with low tolerances.

The technical trick of the first stage, which is run at relatively low temperature and lasts for a long time, is that only as much nitrogen is offered in the furnace atmosphere as diffuses away into the diffusion layer of the workpiece. As a result, further growth of the bonding layer is virtually suppressed and the thin form of the bonding layer is obtained.

In a preferred refinement of the method, the first step or the first stage takes place at 500 to 510° C.

In this case, a carbon donor may be added even in the first step or in the first stage.

It is especially preferable, furthermore, if, in the first step, less nitrogen is fed to the machine component than in a supersaturated furnace atmosphere. Too high a growth of the bonding layer and therefore the embrittlement of the latter are consequently avoided.

So that the increase in the carbon content of the bonding layer takes place quickly and without an appreciable layer growth, according to a preferred refinement of the method the second step or the second stage takes place at 570 to 580° C.

In a preferred further development of the method, the bonding layer is postoxidized. As a result, the run-in behavior of the slide pairing is improved, and microscopic stress peaks during operation are reduced.

In a preferred further development of the method, first the temperature is equalized and/or the bonding layer is seeded and/or the process gas is formed.

The thickness of the bonding layer preferably amounts to 4-15 μm, for example to 6-12 μm.

The thickness of the diffusion layer preferably amounts to at least 50 μm. The thickness of the diffusion layer may therefore amount to at least ten times the thickness of the bonding layer.

The method according to the disclosure can advantageously be applied to a machine component of an axial piston machine.

In an especially preferred application, the component affected is a cylindrical drum of the axial piston machine of sloping axis type of construction or else a bushless cylindrical drum of an axial piston machine of swashplate type of construction. The component affected may also be a drive shaft of the axial piston machine.

BRIEF DESCRIPTION OF THE DRAWINGS

An exemplary embodiment of the disclosure is described in detail below with reference to the figures in which.

DETAILED DESCRIPTION

Figure 1:
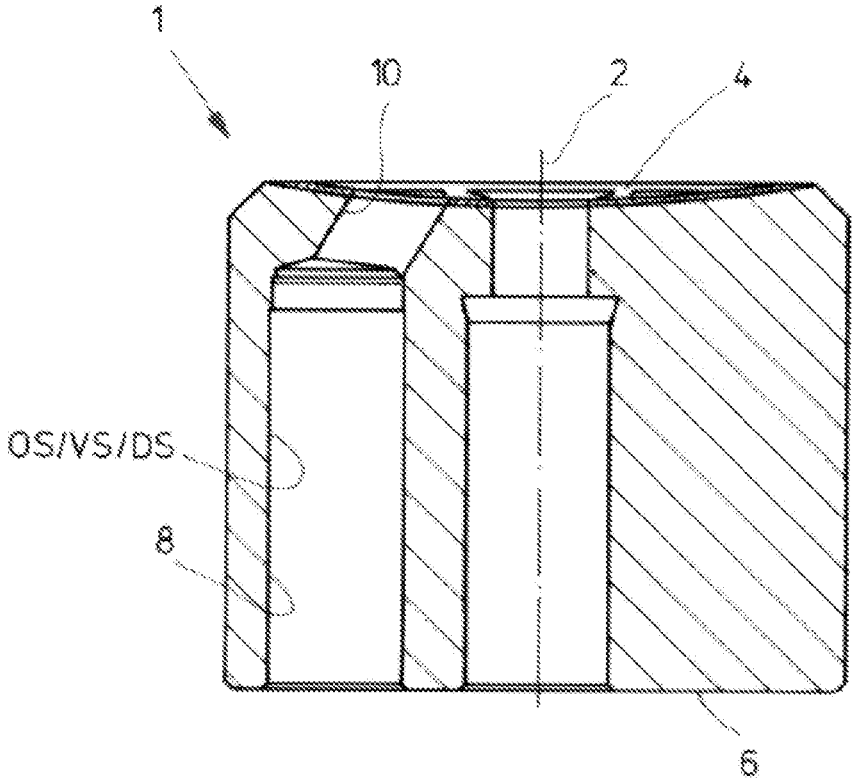
FIG. 1 shows a longitudinal section through a cylindrical drum which has been treated according to the disclosed method.

FIG. 1 shows a cylindrical drum 1 of the exemplary embodiment of the axial piston machine according to the disclosure of sloping axis type of construction in sectional illustration. It has an approximately circular-cylindrical shape and rotates about its longitudinal axis 2 when the axial piston machine is in operation. The cylindrical drum 1 is shaped spherically on one end face 4 and is pressed with this end face 4 against a distributor disk. The other end face 6 confronts a flange of a drive shaft, the cylindrical drum 1 being set in relation to this flange in the case of a fixed-displacement machine and being adjustable at different angles in relation to this flange in the case of a variable-displacement machine.

Figure 2:
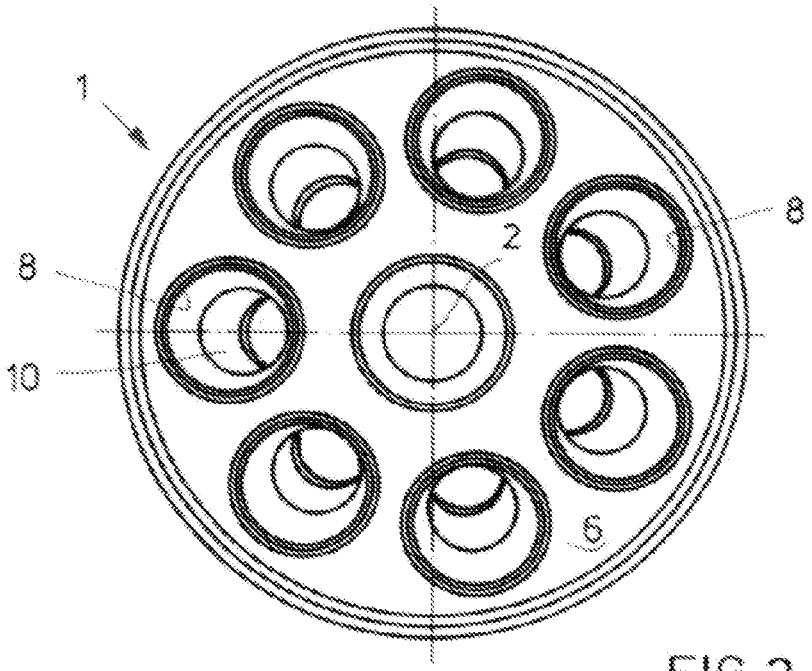
FIG. 2 shows a top view of the cylindrical drum according to FIG. 1.

FIG. 2 shows a top view of the end face 6 of the cylindrical drum 1, said end face confronting the flange or the shaft. A plurality of cylindrical bores 8 are introduced, uniformly distributed, on the circumference of the end face 6 and extend over a large part of the length of the cylindrical drum 1.

Referring to FIG. 1, each cylindrical bore has, in the region of the spherically shaped end face 4, a through bore 10, via which the cylindrical bore 8, during its rotation about the longitudinal axis 2, is connected alternately to a high-pressure kidney-shaped pocket and to a low-pressure kidney-shaped pocket of the distributor disk. Guided in each cylindrical bore 8 is a piston which, on its side facing away from the cylindrical drum 1, is articulated on the flange, and, as a result of the oblique position of the flange, the lifting movement of the piston in the cylindrical bore is generated during common rotation. Consequently, each piston forms with the cylindrical drum 1, more specifically with the cylindrical bore 8, a slide pairing.

According to the disclosure, the cylindrical drum 1 according to FIGS. 1 and 2, after being manufactured, was carbonitrided with gas in a furnace. Consequently, particularly in the region of the surface area of the cylindrical bore 8, an oxide layer OS, a bonding layer VS lying underneath and a diffusion layer DS lying underneath were generated, these layers serving as a wear protection layer of the cylindrical bore 8. Since, in a first stage, gas carbonitriding took place for a comparatively long treatment duration and at a comparatively low temperature of 500 to 510° C., the bonding layer VS has a thickness of 4 to 15 μm, whereas the diffusion layer DS lying underneath has a thickness of at least 50 μm. In a second stage, the carbon content of the bonding layer was increased. For this purpose, the treatment temperature was increased to 570 to 580° C. and the carbonizing potential was increased.

According to the disclosure, the bonding layer (VS) is comparatively thin and at the same time formed in uniform thickness, whereas the diffusion layer (DS) is of comparatively thick form. The thickness ratio of the layers was achieved by gas carbonitriding in two steps or stages, the first step or first stage being characterized by a comparatively low treatment temperature and a comparatively long treatment duration. The second step or second stage is characterized by an increase in the carbonizing potential and an increase in temperature. The carbon content of the bonding layer (VS) was thereby increased. Two-stage gas carbonitriding makes it possible to have dimensional changes of the component which are reduced in comparison with the prior art and to have higher process safety and higher operating safety of the axial piston machine, particularly in the case of components with low tolerances.

A method for forming a wear protection layer of a machine component which with a further machine component forms a slide pairing is disclosed. At least one of the machine components is gas-carbonitrided to minimize wear, a thin uniform bonding layer and a comparatively thick diffusion layer lying underneath being generated in that gas carbonitriding first takes place at a low temperature and for a long duration.

LIST OF REFERENCE SYMBOLS

1 Cylindrical drum
2 Longitudinal axis
4 End face
6 End face
8 Cylindrical bore
10 Through bore
DS Diffusion layer
OS Oxide layer
VS Bonding layer

What is claimed is:

1. A method of gas carbonitriding an iron-containing machine component of a slide pairing, comprising:

forming a diffusion layer on the iron-containing machine component by exposing the iron-containing machine component to a first gas-carbonitriding atmosphere at a first temperature for a first time period; and forming a bonding layer on the iron-containing machine component by exposing the iron-containing machine component with the formed diffusion layer to a second gas-carbonitriding atmosphere at a second temperature for a second time period, wherein the second temperature is greater than the first temperature, the first time period is greater than the second time period, and a concentration of carbon donors in the second gas-carbonitriding atmosphere during the second time period is greater than a concentration of carbon donors in the first gas-carbonitriding atmosphere during the first time period in order to increase a carbon content of the bonding layer.

2. The method of claim 1, wherein the first temperature is in a range from 500 degrees Celsius to 510 degrees Celsius.

3. The method of claim 1, wherein the carbon donors are added to the bonding layer during the forming of the bonding layer and diffusion layer.

4. The method of claim 1, wherein an amount of nitrogen introduced into the first gas-carbonitriding atmosphere is determined based upon an amount of nitrogen to be diffused into the diffusion layer.

5. The method of claim 1, wherein an amount of nitrogen in the first gas-carbonitriding atmosphere is controlled to avoid supersaturation of the first gas-carbonitriding atmosphere.

6. The method of claim 1, wherein the second temperature is in a range from 570 degrees Celsius to 580 degrees Celsius.

7. The method of claim 1, further comprising:

forming an oxide layer on the formed bonding layer.

8. The method of claim 1, further comprising, before forming the bonding layer and the diffusion layer, at least one of:

equalizing the iron-containing machine component temperature at the first temperature;

seeding the bonding layer; and forming a process gas.

9. The method of claim 1, wherein the formed bonding layer has a thickness in a range of 4-15 μm.

10. The method of claim 1, wherein the formed diffusion layer has a thickness of at least 50 μm.

11. The method of claim 1, further comprising assigning the iron-containing machine component to an axial piston machine.

12. The method of claim 11, wherein the iron-containing machine component is a cylindrical drum.

* * * * *